US005532051A

United States Patent [19]

Nishiura et al.

[11] Patent Number: 5,532,051

[45] Date of Patent: Jul. 2, 1996

[54] STEEL SHEET EXCELLENT IN COATING SHARPNESS, DEFECT-FORMATION RESISTANCE AND WORKABILITY

[75] Inventors: Tetsuya Nishiura; Motofumi Kurahashi; Masanori Takemoto; Hiroyuki Kawano; Motohiro Nakayama; Masato Yamada, all of Tokai, Japan

[73] Assignee: Nippon Steel Corporation, Tokyo, Japan

[21] Appl. No.: 256,226

[22] PCT Filed: Oct. 21, 1992

[86] PCT No.: PCT/JP92/01369

§ 371 Date: Aug. 25, 1994

§ 102(e) Date: Aug. 25, 1994

[87] PCT Pub. No.: WO93/12897

PCT Pub. Date: Jul. 8, 1993

[30] Foreign Application Priority Data

Dec. 25, 1991 [JP] Japan ..... 3-356482
Dec. 27, 1991 [JP] Japan ..... 3-358155

[51] Int. Cl.[6] ..... B32B 9/00

[52] U.S. Cl. ..... 428/217; 428/220; 428/156; 428/457; 72/353.6

[58] Field of Search ..... 428/156, 141, 428/167, 220, 217, 457; 72/353.6

[56] References Cited

U.S. PATENT DOCUMENTS 3,873,392 3/1975 Niebylski et al. ..... 428/141
4,111,032 9/1978 Rault ..... 72/366
5,061,545 10/1991 Li et al. ..... 428/156
5,275,864 1/1994 Kenmochi ..... 428/156

FOREIGN PATENT DOCUMENTS 48-024628 7/1973 Japan .
2-197301 8/1990 Japan .
3-204103 9/1991 Japan .
4081204 3/1992 Japan .

*Primary Examiner*—Patrick J. Ryan
*Assistant Examiner*—Cathy K. Lee
*Attorney, Agent, or Firm*—Kenyon & Kenyon

[57] ABSTRACT

To obtain a high tensile strength steel sheet which has an improved lubricating ability during press working, coating sharpness and defect-formation resistance, and which is useful as an outer plate of automobiles and electrical appliances, by forming uniform recesses and protrusions thereon and regulating the shapes of the recesses and protrusions, the recesses each having a flat portion at their bottom, and the size of the protrusion top faces, the depth between the recesses and the protrusions and the peak-to-peak distance being restricted. The recesses and protrusions formed thereon satisfy the following conditions; oil pools are formed thereon in an area covering 30% of the surface thereof; the top faces of the protrusions each having a size of 10 to 450 μm; the level difference between the recesses and the protrusions being from 2 to 20 μm; the peak-to-peak distance of the protrusions being from 50 to 1000 μm; P and D satisfying the relationship $2.2<P/D<5$, and the recess area being at least 85%.

8 Claims, 10 Drawing Sheets

STEEL SHEET EXCELLENT IN COATING SHARPNESS, DEFECT-FORMATION RESISTANCE AND WORKABILITY

FIELD OF THE INVENTION

The present invention relates to a steel sheet excellent in coating sharpness, defect-formation resistance and workability and used as an outer plate, etc., of automobiles and electrical appliances.

BACKGROUND OF THE INVENTION

Steel sheets for automobiles are required to be light from the viewpoint of improving fuel consumption and overcoming environmental problems, etc. Various high tensile strength steel sheets have, therefore, been developed for the purpose of using thin steel sheets.

Moreover, attention has also been paid to strengthening a steel sheet from the viewpoint of the safety of automobiles, and the future development strengthened steel sheet is anticipated.

The workability (plastic elongation) of steel sheets for automobiles is lowered as they are strengthened. Accordingly, securing both high tensile strength and good elongation is a problem to be solved in the development of high tensile strength steel sheets, and a great deal of research has been conducted in this area.

On the other hand, lubricants used for press working steel sheets have also been developed to avoid the partial constraint thereof during press working. The viscosity of the lubricant is increased to improve the oil film-forming ability during press working, and an extreme-pressure additive is used for preventing partial seizure.

On the other hand, steel sheets which are of higher grade and more diversified than those currently used are required as products become more accurate and complicated. Steel sheets are also required to have coating sharpness. There has been known a technique, to responds to this requirement, comprising forming fine recesses and protrusions on a roll using a laser and rolling a steel sheet with the roll to obtain a steel sheet excellent in coating sharpness, as disclosed, for example, by Japanese Unexamined Patent Publication (Kokai) No. 63-132701.

Even when the elongation of a high tensile strength steel sheet is obtained for the purpose of aiming at an improvement in the press workability, a decrease in the elongation caused by strengthening the steel sheet has heretofore been inevitable. As a result, an improvement in the workability cannot be expected. Accordingly, to improve the workability of the steel sheet, an improvement in the lubricating ability may be considered. However, when the viscosity of a lubricant oil is increased, there arise serious problems that the capacity of existing machines is lowered and that the cleanability in the latter step is lowered. As a result, there is a limitation on increasing the viscosity, and the viscosity cannot be greatly increased.

Moreover, since the action of an extreme-pressure additive is fundamentally of a reaction type, the addition thereof in a large amount influences the cleanability and coating properties of steel sheets.

Furthermore, the coating sharpness of a steel sheet is more improved when the surface of the steel sheet becomes closer to a mirror-finished surface. Various proposals have been made in the direction of decreasing the surface roughness thereof. However, when the surface roughness is decreased, defects thereon tend to become manifest in the steps of heat treating and plating. Moreover, surface defects are formed during piling and press working subsequently to shearing the steel sheet, and become quality defects. Accordingly, the surface roughness Ra of a steel sheet is currently made at least 0.75 μm. An object of the present invention is to solve the recent problem of press workability associated with strengthening a steel sheet and provide a steel sheet of high quality corresponding to the coating sharpness which is a quality thereof.

CONSTRUCTION OF THE INVENTION

To achieve the object as described above, the present invention intends to improve the workability of a steel sheet by giving it recesses having each a flat portion at their bottoms and forming oil pools in an area of at least 30%, and to improve the coating sharpness and defect-formation resistance thereof by giving it uniformly distributed recesses and protrusions, the size D of each of the regularly distributed protrusion faces being from 10 to 450 μm, the level difference between the recesses and the protrusions being from 2 to 20 μm, the peak-to-peak distance of the protrusions being from 50 to 1,000 μm, P and D satisfying the relationship $2.2<P/D<5$, and the recess area being at least 85%. That is, the present invention is characterized in that the workability, coating sharpness and defect-formation resistance of a steel sheet is improved by forming a steel sheet with a work roll the surface of which has been processed by microlithography, whereby uniformly distributed recesses and protrusions are formed thereon without forming raised portions, and that the workability, coating sharpness and defect-formation resistance thereof are improved by regulating the shapes and distribution of the recesses and protrusions as described above.

BEST MODE FOR PRACTICING THE INVENTION

The best mode for practicing the present invention will be explained below in detail.

The subject matter of the present invention is to provide a mild steel sheet and a high tensile strength steel sheet having uniform recesses on the steel sheets and as a result exhibiting improved oil-pooling properties thereon, the recesses each having a flat portion at the bottom for further securing an oil-pooling effect.

That is, steel materials, lubricants, etc., have heretofore been developed to make a mild steel sheet and a high tensile strength steel sheet exhibit good press formability. To improve the workability of the steel sheets, the present invention further imparts an oil-pooling effect thereto.

In general, a steel sheet having recesses and protrusions thereon can be most stably produced at the lowest cost by rolling a steel sheet subsequently to annealing with a skin pass roll having recesses and protrusions.

Figure 1A:
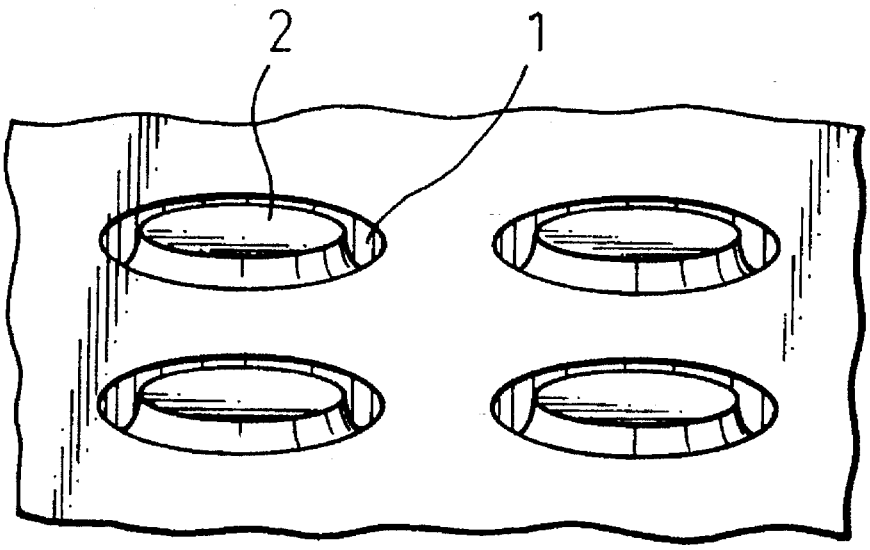
FIGS. 1*a* and 1*b* show shows a surface schematic view and a cross sectional view of a steel sheet produced by a high energy density laser.
Figure 1B:
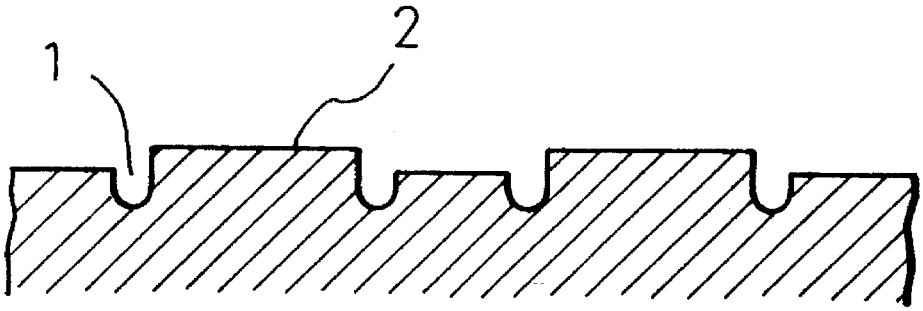

The skin pass roll can be processed by a high density laser. FIG. 1 shows a surface schematic view of a steel sheet produced by the procedure. According to the procedure, an oil-pool portion 1 in a ring form can be formed. Since a ring central portion 2 protrudes, however, the ring central portion 2 which is a protrusion of the steel sheet firstly comes into contact with a press mold during press working. As a result, the oil-pool portion 1 does not become effective.

Moreover, there is a limitation on the oil-pool area and oil-pool volume obtained by the roll working procedure, and optimum oil-pool grooves cannot be obtained.

Figure 2A:
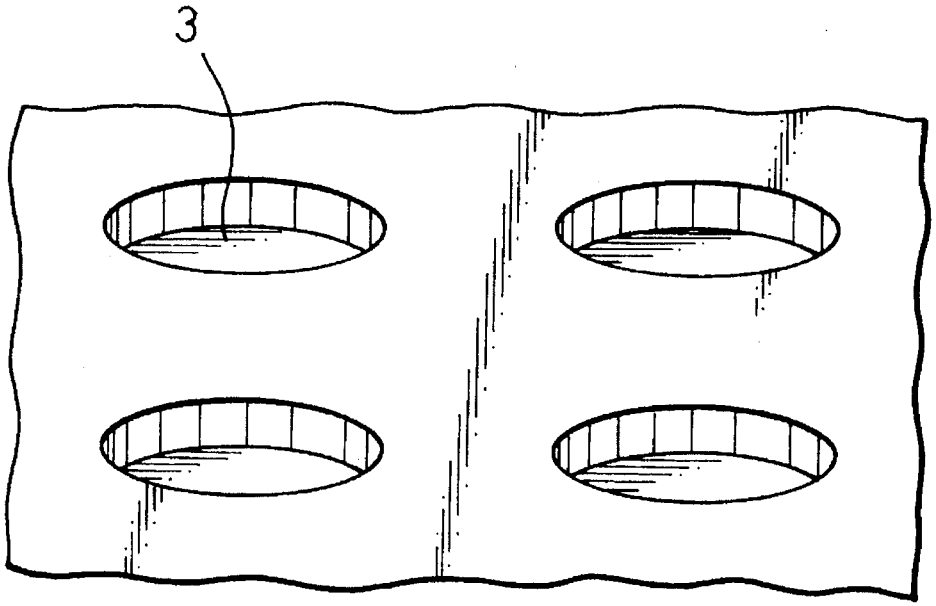
FIGS. 2*a* and 2*b* show a schematic view and a cross sectional view of a steel sheet surface of recess-closing type (pool type) obtained by microlithography (type I).
Figure 2B:
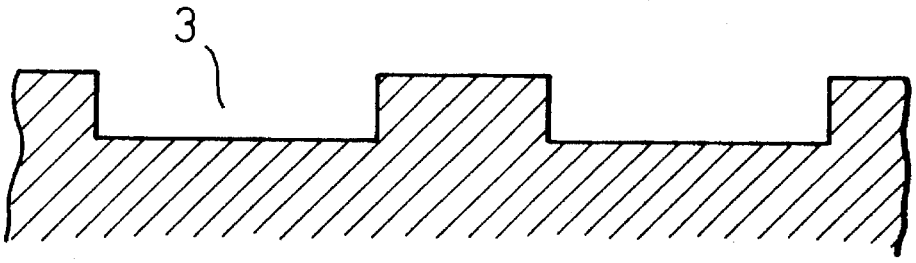

For the purpose of making a steel sheet surely exhibit the oil-pooling effect, the steel sheet is skin pass rolled with a skin pass roll which has been processed by microlithography to form uniform recesses without protruding portions thereon. Then, the press workability test of the steel sheet is run. FIG. 2 shows surface schematic views of a recess 3 obtained by the procedure. In this case, the recess is in a closed shape, and is termed microlithography type I.

Figure 3:
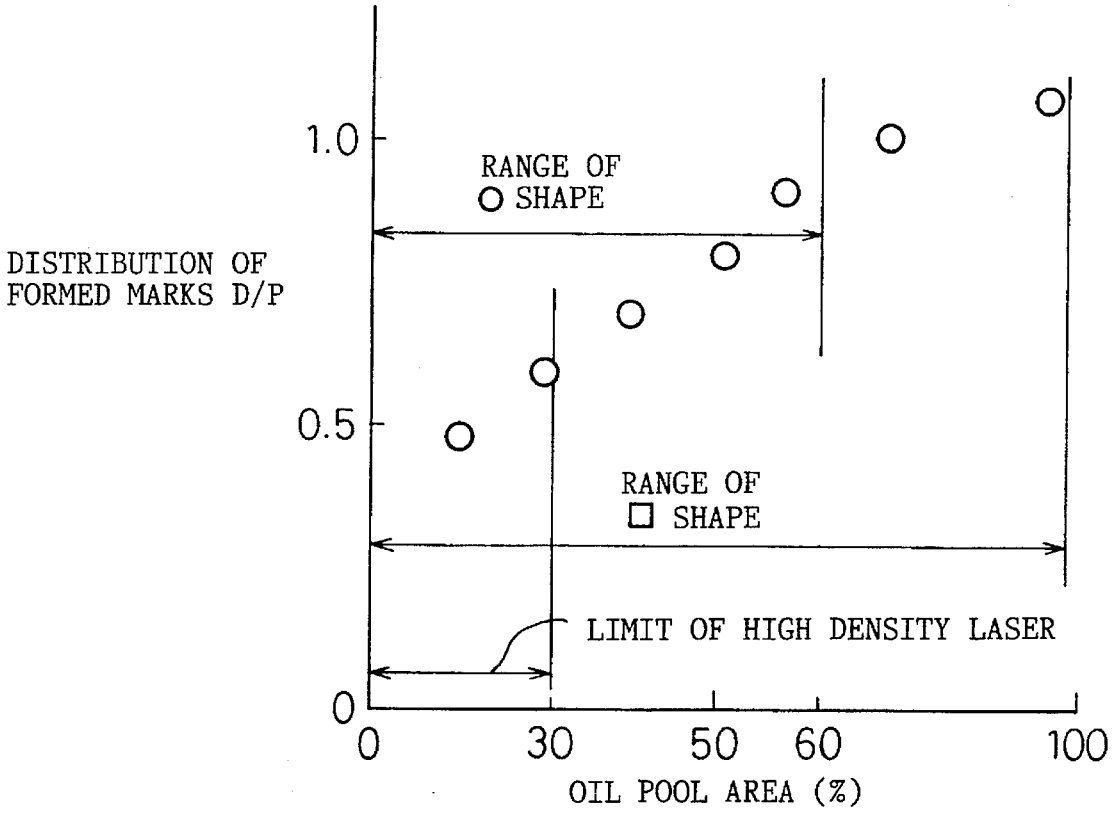
FIG. 3 is a graph showing a relationship between the distribution D/P of formed marks obtained by microlithography, and the area ratio of oil pools.

FIG. 3 shows mark shapes, mark pitches and oil-pool area ratios of the steel sheets thus obtained.

The shape range in FIG. 3 is as described below.

In the case of the recesses being each in a circular shape and existing each independently (independently existing condition: $2r<P$) as shown in FIG. 4, the maximum area ratio is obtained as follows:

So (shaded portions)$=\pi r^2/P^2\times 100(\%)$

Smax being obtained when $2r=P$ $Smax=\pi r^2/P^2\times 100\approx 78\%$ (theoretical value).

Figure 4A:
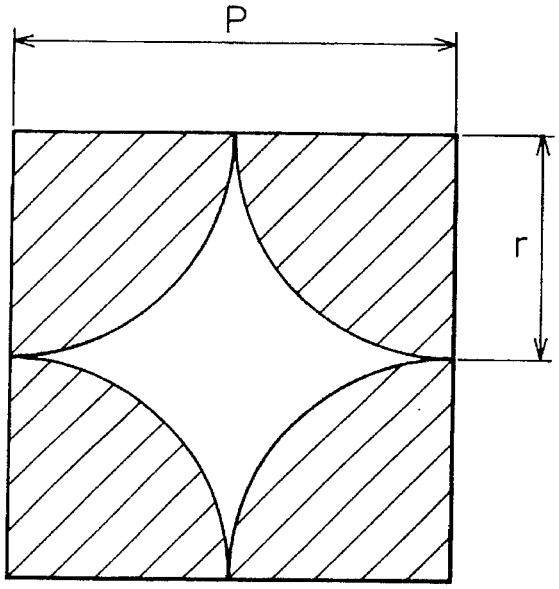
FIGS. 4*a* and 4*b* shows explanatory views of shape distributions of recesses each having a circular shape in the case of the maximum area ratio, and isolation.
Figure 4B:
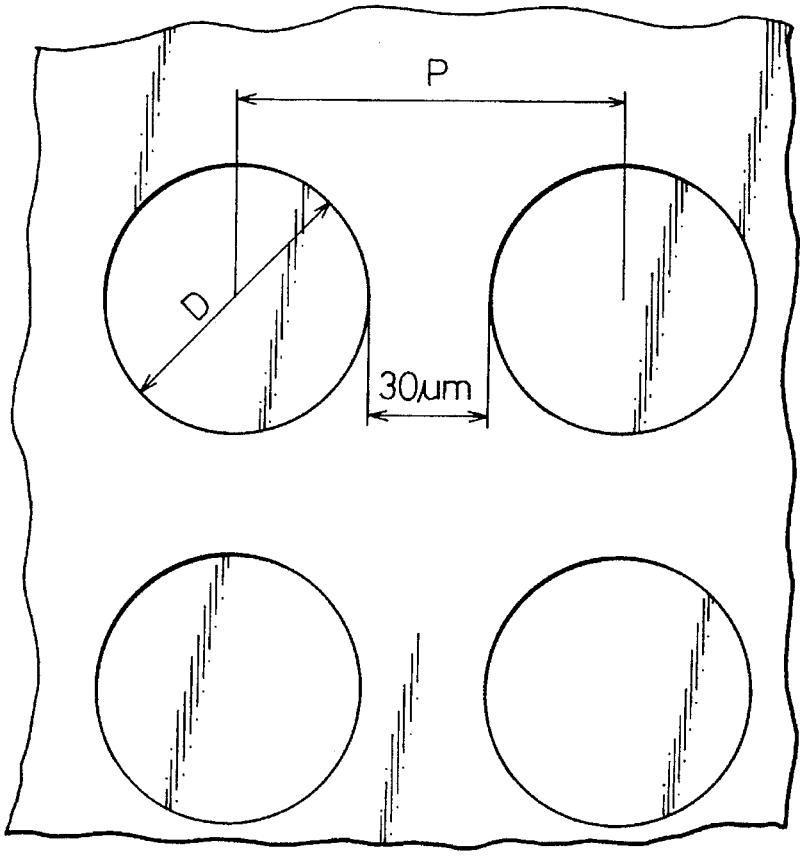

In the case of the recesses being in a circular shape, a typical possible range of the production is as shown in FIG. 4(*b*) wherein the size of the circle D=200 μm, the spacing is 30 μm, and the area ratio $S=\pi r^2/P^2\times 100\approx 60\%$.

That is, when the shape of the recesses is circular, a steel sheet having an oil pool area of up to 60% can be produced.

Figure 5:
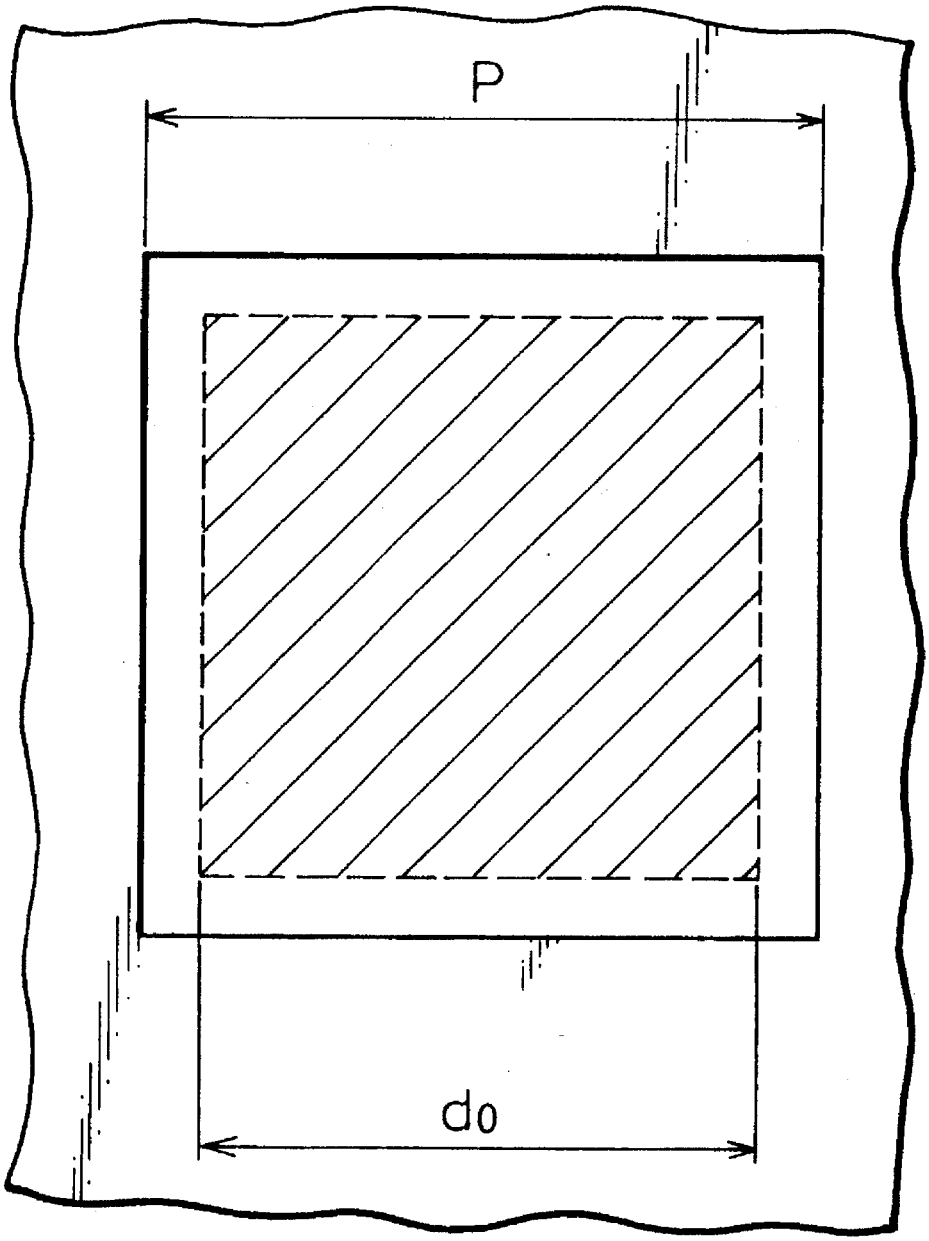
FIG. 5 is an explanatory view of a shape distribution of a recess having a square shape.

Similarly, in the case of the recesses being each in a square shape and existing each independently (independently existing condition: $d0<P$) as shown in FIG. 5, the maximum area ratio is obtained as follows:

So (shaded portions)$=d0^2/P^2\times 100$ (%)

Smax being obtained when $d0=P$ $Smax=d0^2/P^2\times 100=100\%$ (theoretical value).

In the present invention, preferable dimensional conditions of recesses in the steel sheet are as follows: a recess diameter of 20 to 600 μm, a recess pitch of 10 to 1000 μm and a recess depth of 1 to 20 μm. As shown in FIG. 3 according to the discovery of the present inventors, the oil-pool area can be increased to 90% by selecting a mark in this procedure. On the contrary, the oil pool area cannot be increased to at least 30% by other procedures such as using a high density laser.

Figure 6:
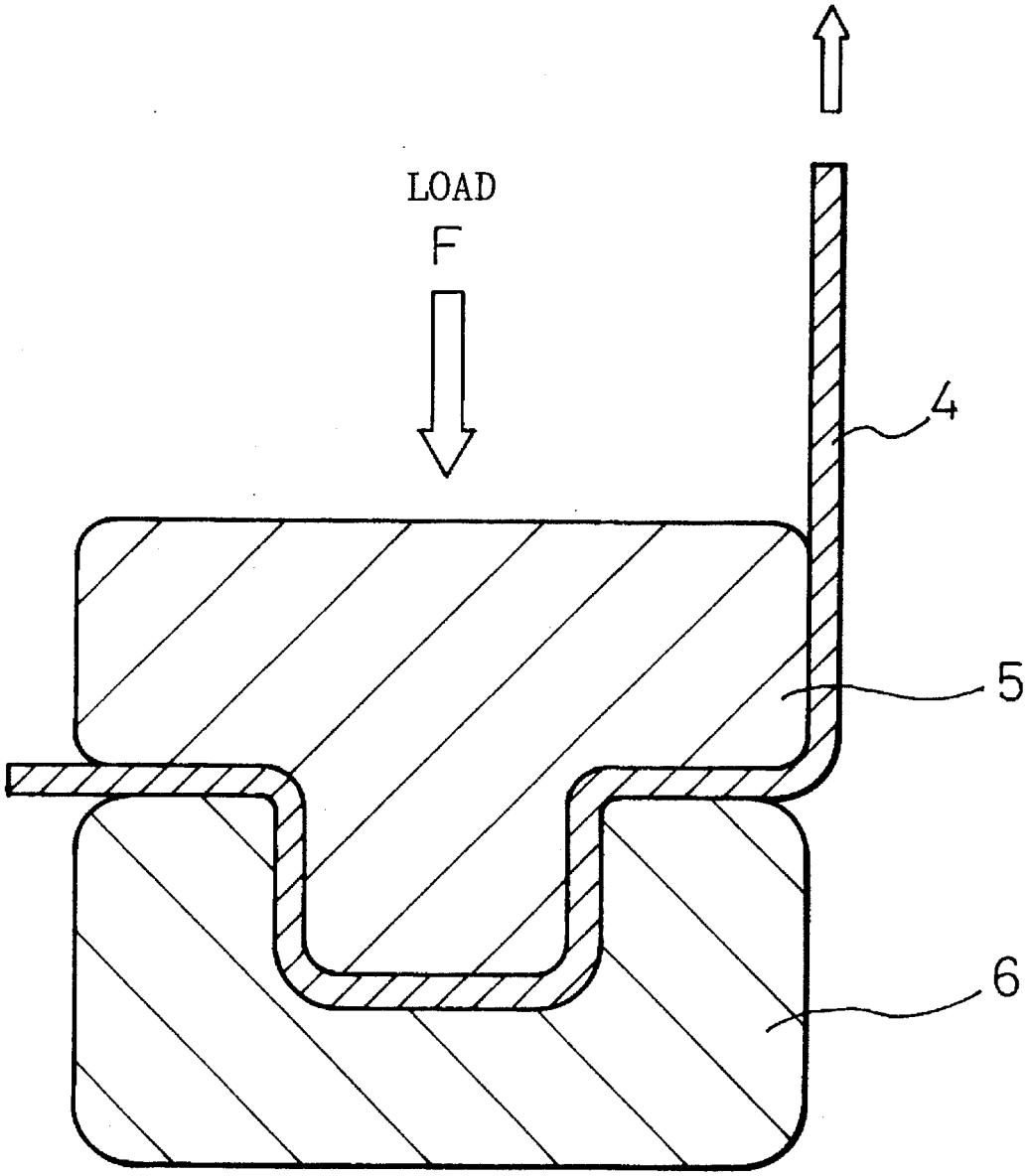
FIG. 6 is a cross sectional view showing a test unit for press workability.
Figure 7:
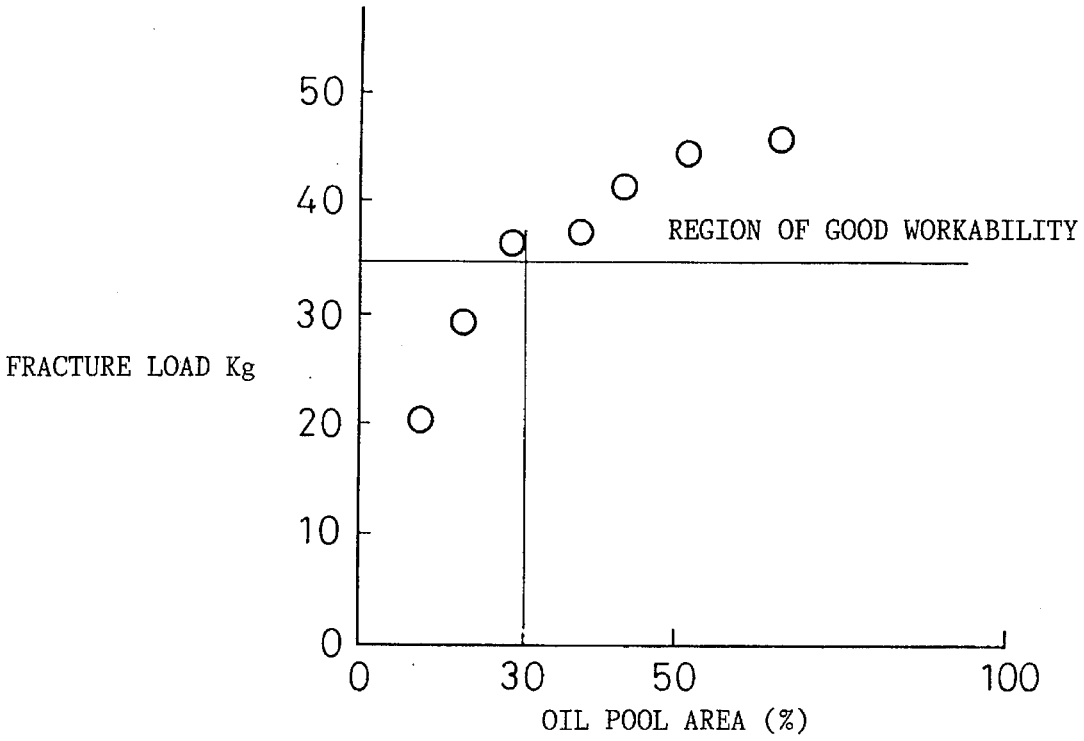
FIG. 7 is a graph showing the results of press workability test on high tensile strength steel sheets.
Figure 8A:
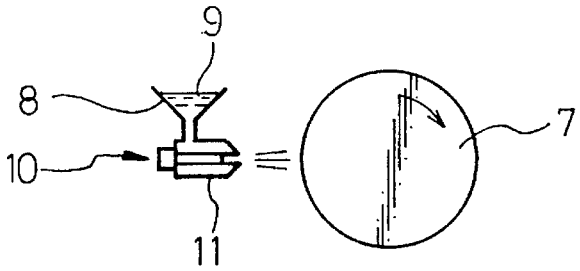
FIGS. 8*a*, 8*b*, 8*c* and 8*d* show explanatory views and exhibiting an example of working steps for imparting recessed and protruding portions according to the present invention by lithography.
Figure 8B:
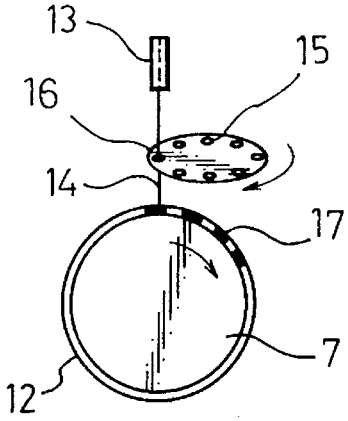
Figure 8C:
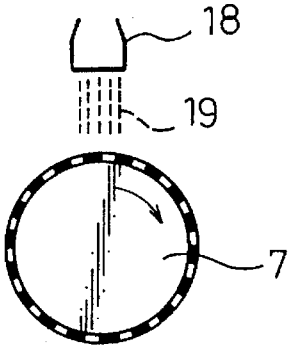
Figure 8D:
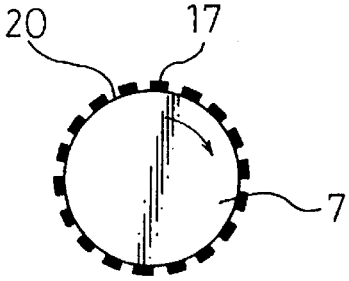

FIG. 6 shows a test unit for testing the press workability of a steel sheet. A steel sheet 4 is pressed between an upper die 5 and a lower die 6 at a certain load. The steel sheet 4 is then pulled upwardly, and the press workability thereof is evaluated from the fracture load thereof. FIG. 7 shows the test results of the press workability of steel sheets worked by the procedure. The press workability increases with an increase in the oil pool area ratio, and steel sheets having good workability can be obtained when the area ratio becomes at least 30%.

In addition, the object steel sheets of the present invention are a cold-rolling steel sheet, a surface-treated mild steel sheet and a high tensile strength steel sheet. The high tensile strength steel sheet corresponds to a steel sheet having a high tensile strength of at least 35 kgf/mm$^2$.

The most typical applications of the steel sheets required to exhibit coating sharpness and press formability are for use in outer plates of automobiles and electrical appliances. Based on the background of the recent trend in enhancing rust prevention in the industry as a whole, the adoption of plated steel sheets such as a hot dip zinc-coated steel sheet, an alloyed hot dip zinc-coated steel sheet, a double layer type alloyed hot dip zinc-coated steel sheet having been electroplated with Fe-Zn alloy, an electrogalvanized steel sheet, a single layer type or double layer type Fe-Zn alloy-electroplated steel sheet and a Zn-Ni alloy-electroplated steel sheet including one coated with resin has prevailed. The present invention imparts particularly excellent coating sharpness, press formability and defect-formation resistance subsequent to surface treatment to these surface-treated steel sheets as well as to a cold rolled steel sheet.

In the production of an alloyed hot-dip zinc-coated steel sheet and a double layer type alloyed hot-dip zinc-coated steel sheet electroplated with Fe-Zn alloy, the steel sheets have an uneven surface due to the formation of Fe-Zn binary alloy crystals in the alloying treatment process subsequent to hot dip zinc coating. As a result, there arises a problem that the microscopic surface smoothness of a cold-rolling steel sheet as a product is deteriorated and the coating sharpness and the press formability thereof are lowered. The surface profile of the steel sheets can be well controlled compared with conventional techniques by a procedure of the present invention which will be described later. Accordingly, the present invention exhibits significant effects on improving the properties of steel sheets of such species.

The formation of significantly recessed and protruding portions on the surface caused by a thermal diffusion reaction does not take place in electrogalvanized steel sheets as a whole and hot dip zinc-coated steel sheets which have not been subjected to alloying treatment. However, the surface smoothness of the substrate steel sheet is deteriorated as the plating layer thickness increases. The present invention is overwhelmingly advantageous compared to conventional methods in excluding the influence and enhancing the coating sharpness and the press formability of these steel sheets. Moreover, in the steel sheets of the present invention whose surface profile has been controlled, the contact between the smooth portions thereof and a transportation unit or press machine is inhibited as described later. As a result, the steel sheets exhibit excellent defect-formation resistance, and especially the surface-treated steel sheets as mentioned above can be prevented from being damaged in the smooth portions of the plated layer. Accordingly, the effects of the present invention are significant.

It is needless to say that the present invention is useful for steel sheets for cans including principally a tin-coated steel sheet and a chromium-coated steel sheet, an aluminum-coated steel sheet and a stainless steel sheet in addition to a cold-rolling steel sheet and a zinc-coated steel sheet.

A procedure for obtaining a steel sheet surface of microlithography type II, namely a recess-opening type (crest type) (refer to FIG. 9) will be described below. There will be described below the reasons for defining the following surface conditions of the steel sheet of the present invention having coating sharpness and defect-formation resistance; the size D of regularly distributed protrusion top faces of 10 to 450 μm, the level difference of recesses and protrusions of 2 to 20 μm, the peak-to-peak distance P of protrusions of 50 to 1000 μm, P and D satisfying the relationship $2.2<P/D<5$, and the recess area of at least 85%.

Firstly, when the protrusing top faces each have a size D of less than 10 μm, the protrusing top faces cannot endure a pressing load by a press unit and are broken due to the needle-like shape thereof, and the effect of preventing defect formation cannot be expected. Moreover, when the protrusion top faces each have a size D exceeding 450 μm, the steel sheet protrusion surface comes into direct contact with metal due to insufficient supply of lubricant oil thereto, and defects tend to form between the steel sheet, and a die and a punch due to an increase in the friction coefficient.

When the level difference between the recesses and the protrusions is less than 2 μm, a punch or die comes into contact with the recesses on the steel sheet during press working, and as a result defects tend to be formed. Moreover, when the level difference therebetween exceeds 20 μm, defect formation does not take place during press working. However, the recesses and the protrusions on the steel sheet do not disappear after coating due to a large level difference therebetween, and as a result the coating sharpness of the steel sheet is lowered.

When the peak-to-peak distance of the protrusions is less than 50 μm, the protrusion faces become needle-like in shape. As a result, the protrusions cannot endure the pressing load of a press unit, and are broken. The effect of preventing defect formation cannot, therefore, be expected. When the peak-to-peak distance of the protrusions exceeds 1000 μm, the area that the steel sheet protrusions cover becomes small, and the load per protrusion becomes large. As a result, the steel sheet protrusion top faces come into metal contact with a die or punch during press working. The steel sheet protrusion top faces are then scraped, and the friction coefficient between the top faces and a die or punch increases. As a result, defects tend to be formed between the steel sheet and a die or punch.

When the ratio of P/D is less than 2.2, the recess area becomes less than 85%, and the coating sharpness of the steel sheet is lowered. Moreover, when the size D of the steel sheet protrusion top faces is small, the protrusions are broken. When the size D of the steel sheet protrusion top faces is large, the area of the steel sheet protrusions becomes large. The steel sheet protrusion surface tends to come into direct metal contact due to an insufficient supply of lubricant oil to the surface, and the friction coefficient is increased. As a result, defects tend to be formed between the steel sheet and a die or punch. When the ratio of P/D exceeds 5, the recess area becomes at least 95%, and the coating sharpness is improved. However, the area that the steel sheet protrusions covered becomes small regardless of the magnitude of the size D of the steel sheet protrusion top faces, and the load per protrusion becomes large. The steel sheet protrusion top faces then tend to come into metal contact with a die or punch during press working. As a result, the steel sheet top faces are scraped, and the friction coefficient between the steel sheet protrusion top faces and a die or punch is increased. Defects then tend to be formed between the steel sheet and a die or punch.

To obtain the steel sheet of the present invention, it is advantageous to form fine patterns on a roll by microlithography, and roll a steel sheet using the roll. Such a rolling roll is usually used as a skin pass roll subsequently to annealing. When a steel sheet is hot dip coated after annealing as in the case of a hot dip zinc-coated steel sheet, the hot dip coated steel sheet is rolled by the skin pass roll. The steel sheet is optionally skin pass rolled with a discharge dull roll, a shot dull roll or bright roll before or after rolling with the microlithography roll. That is, skin pass rolling can also be practiced twice. In addition, since the procedure of the present invention improves the defect-formation resistance of a steel sheet, the defect-formation resistance at the time of passing a steel sheet during annealing or in the process subsequent to plating can be improved by the use of the microlithography roll as the finish stand roll of the cold rolling rolls. Accordingly, the production of high grade products becomes possible. In such a case, skin pass rolling subsequent to annealing or annealing and plating can be carried out with any of a microlithography roll, a discharge dull roll, a shot dull roll and a bright roll. The steel sheet may also be rolled twice using a combination of these rolls.

Figure 9:
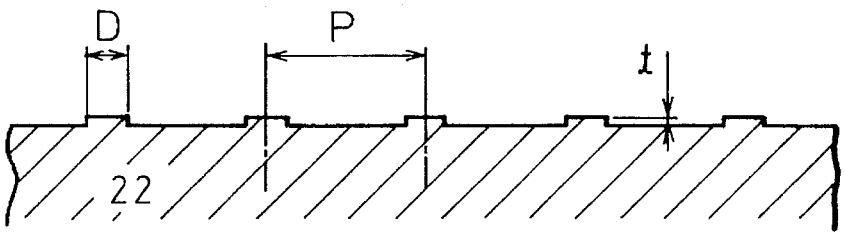
FIG. 9 is a cross sectional schematic view of a steel sheet of recess-opening type (crest type) obtained by the present invention (microlithography (type II)).

As shown in FIG. 8, fine recessed and protruding patterns are formed by irradiating a roll surface having been coated with a resist sensitive to a light having a specific wavelength, developing the resist, etching the roll surface through chemical or vapor layer etching, and removing the cured resist portions. FIG. 9 shows the cross sectional schematic view of the steel sheet thus obtained. In the figure, P, D and t designate a peak-to-peak distance of the protrusions, a size of the protrusion top faces and a level difference between the recesses and the protrusions, respectively. The roll can be coated with chromium after the treatment in FIG. 9, and the life of the roll can be markedly extended when the chromium-coated roll is used.

EXAMPLES

The effect of the present invention will be illustrated more in detail below by making reference to examples.

Example 1

A high tensile strength cold-rolling steel sheet, having been annealed, was rolled with a skin pass roll (550 mm in diameter, 1800 mm length) on which patterns having a recess distribution with a depth of 5 μm as shown in FIG. 9 had been formed by microlithography. The press workability of the steel sheet thus obtained was evaluated using an actual press.

The high tensile strength steel sheet thus obtained had an oil-pool area ratio of 65% on the surface.

A high tensile strength steel of a 60 $kg/mm^2$ class prepared by adding Si to a low carbon steel had been used for preparing the steel sheet.

Table 1 shows a number of samples which formed cracks in a test with an actual press. None of samples obtained from the high tensile strength steel sheet according to the present invention formed cracks, and, therefore, good results were obtained.

Table 2 shows a number of samples in which press defects were formed. Similar good results with regard to press defects could also be obtained.

TABLE 1

| Number of samples cracked with an actual press | |
|---|---|
| | Number of samples with cracks |
| Steel of invention | 0/230 |
| Conventional steel | 30/230 |

TABLE 2

| Number of samples having press defects formed with an actual press | |
|---|---|
| | Number of samples with press defects |
| Steel of invention | 0/420 |
| Conventional steel | 62/420 |

Example 2

Patterns were formed on a skin pass roll by microlithography as shown in FIG. 8.

An embodiment of forming recessed and protruding patterns on the surface of a roll 7 is shown in FIG. 8(*a*) to FIG. 8(*d*). That is, firstly, a visible light-curing type photosensitive resin composition 9 is fed to a photosensitive resin composition feeder 11 from a hopper 8 provided above the feeder 11. The roll is coated with the visible light-curing type photosensitive resin composition 9 by blown air 10 and a visible light-curing type photosensitive resin composition layer 12 having a predetermined thickness is formed. Subsequently, the visible light-curing type photosensitive resin composition layer 12 is intermittently irradiated at a predetermined regular pitch with a laser beam 14 which has a wavelength in the visible light region and is emitted from a laser light source 13, whereby the irradiated portions are cured [(b)]. Although the laser beam 14 is intermittently irradiated by rotating a chopper 16 having slits 15 in FIG. 8(*b*), the intermittent irradiation is not limited to the procedure as mentioned above. For example, the irradiation may also be carried out by polarization control of a continuously laser beam, pulsing the laser, and the like. The coated roll surface is then sprayed with a cleaning agent 19 such as 1,1,1-trichloroethane by an injector 18 as shown in FIG. 8(*c*), whereby non-cured portions are removed and resin composition cured portions 17 remain as shown in FIG. 8(*d*). Exposed roll surface portions 20 thus obtained are subsequently etched by an etchant, etc., to form recesses, and regularly recessed and protruding patterns are formed as shown in FIG. 8(*d*).

In addition, although recessed and protruding patterns are formed on the roll by etching, the formation thereof is not limited to etching, and can be formed, for example, by plating, vacuum deposition, dry etching or the like procedure.

An annealed cold rolled steel sheet and an alloyed hot dip zinc-coated steel sheet both having a thickness of 0.8 mm were skin pass rolled at a draft of 0.8% using the work roll to form a profile as shown in FIG. 9 on the steel sheets. The alloyed hot dip zinc-coated steel sheet had a coating amount of 60 g/m$^2$ per side. The alloyed hot dip zinc-coated steel sheet (double layer type) having been electroplated with Fe-Zn alloy had a hot dip coating layer in an amount of 60 g/m$^2$ and an electroplating layer (containing 80% by weight of Fe) in an amount of 4 g/m$^2$. The coating layers all exhibited good adhesion. The defect formation of the steel sheets thus obtained were evaluated by the test shown in FIG. 10. The evaluation test is carried out as follows: a test steel sheet 22 is placed on a surface-finished surface plate 23 (Ra<0.05 μm) and is pressed downwardly by a surface-finished punch 21 (Ra<0.05 μm) at a pressing pressure of 1 kg/cm$^2$; the steel sheet free from coating oil is drawn at a rate of 100 mm/min; and the scratches, etc. thus formed thereon are visually observed after drawing. Moreover, the steel sheets subsequent to skin pass rolling were coated, and the coating sharpness was measured. The measurement was made in accordance with "a method for measuring specular gloss" specified by JIS Z 8741. The results are shown in Table 3.

It is evident from Table 3 that the steel sheets in Test Nos. 2 to 3, 7 to 11, 16 to 17 and 20 to 21 which belonged to examples of the invention exhibited significantly good results with regard to defect formation and coating sharpness compared with those in Test Nos. 1, 4 to 6, 14 and 15 of comparative examples, and those in Test Nos. 12, 13, 18 to 19 and 22 to 23 prepared by the conventional method disclosed in Japanese Unexamined Patent Publication (Kokai) No. 63-132701.

Figure 11:
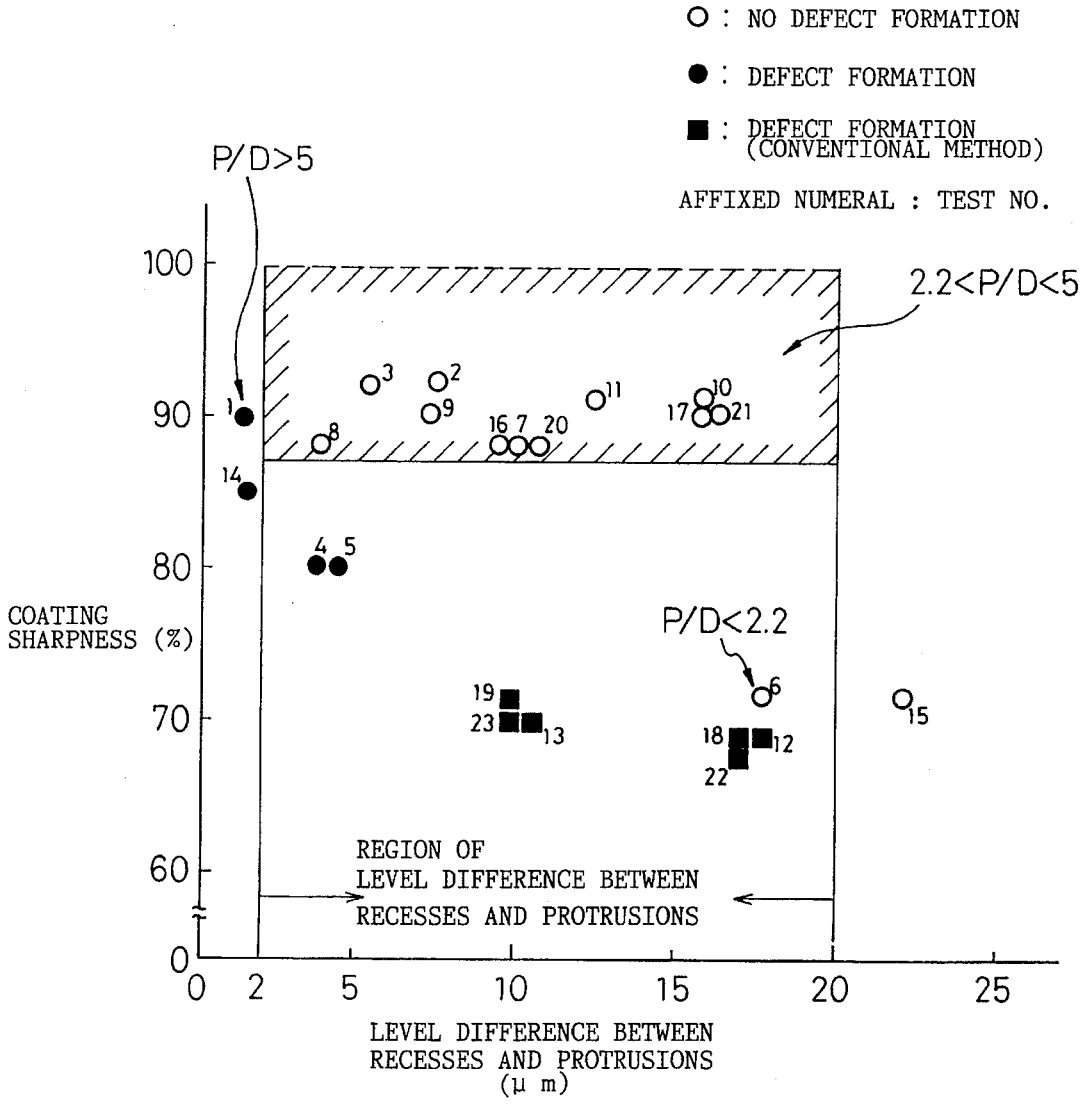
FIG. 11 is a graph showing the relationship between the level difference of recesses and protrusions and the coating sharpness in Example 2 of the present invention.

FIG. 11 is a graph obtained by plotting the data in Table 3, with the level difference (μm) between recesses and protrusions as abscissa and the coating sharpness (%) as ordinate. The scope of the present invention is in the shaded region. The steel sheets having a level difference between recesses and protrusions of greater than 20 μm exhibit a deteriorated coating sharpness (Test No. 15). The steel sheets having a level difference therebetween of less than 2 μm exhibit deteriorated defect-formation resistance (Test No. 14).

The coating sharpness which is judged to be good in the present invention agrees with the evaluation level of that obtained when the steel sheets for automobiles are practically used as automobile outer plates after coating. When the ratio of P/D is less than 2.2 (Test No. 6), the coating sharpness is lowered because the recess area becomes less than 85%. Moreover, when the size D of each of the protrusion top faces of a steel sheet is small, the protrusions are broken. When the size D of each thereof is large, the area of the steel sheet protrusions become large. The steel sheet then tends to come into direct contact with metal due to an insufficient supply of lubricant oil on the steel sheet protrusion surface. As a result, the friction coefficient of the steel sheet is increased, and defects, etc., tend to be formed between the steel sheet and a die or punch. When the ratio of P/D exceeds 5 (Test No. 1), the area of recesses becomes at least 95%, and the sharpness of the steel sheet subsequent to coating is improved. However, the area covered by the steel sheet protrusions decreases regardless of the size D of the steel sheet protrusion top faces, and the load maintained per protrusion becomes large. As a result, the steel sheet protrusion top faces tend to come into metal contact with a die or punch during press working. The top faces thereof are then scraped, and defects, etc., tend to be formed between the steel sheet and a die or punch due to an increase in the friction coefficient therebetween. The steel sheets in Test Nos. 4 and 5 each had a small area ratio of recesses, and exhibited a poor coating sharpness. D and P of the steel sheets also fell outside the range of the present invention, and defects were formed thereon. The steel sheets of Test Nos. 12, 13, 18, 19, 22 and 23 were of conventional type, and exhibited a poor coating sharpness and poor defect-formation resistance.

It is clear from the results of Table 3 and FIG. 11 that the steel sheets produced by the present invention are free from defect formation and are significantly excellent in coating sharpness compared with those produced in Comparative Examples and Conventional Methods.

TABLE 3

| | Mark size (steel sheet) | | | | | | | | |
|---|---|---|---|---|---|---|---|---|---|
| Test No. | Mark dia. D mm | Pitch P | P/D | *Level differ-erence | Area of recesses | Defect formation | Coating sharpness (%) | Note (1) | Note (2) |
| 1 | 8 | 53 | 6.6 | 1.5 | 98 | Yes | 80 | C.E. | |
| 2 | 11 | 53 | 4.8 | 7.5 | 95 | No | 92 | Ex. | |
| 3 | 200 | 980 | 4.9 | 5.3 | 95 | No | 92 | | |
| 4 | 440 | 1080 | 2.5 | 3.8 | 75 | Yes | 80 | C.E. | Cold-rolling |
| 5 | 470 | 980 | 2.1 | 4.3 | 71 | Yes | 80 | | steel sheet |
| 6 | 200 | 360 | 1.8 | 17.8 | 75 | No | 71 | | |
| 7 | 200 | 450 | 2.3 | 10.0 | 85 | No | 88 | | |
| 8 | 440 | 980 | 2.2 | 3.8 | 85 | No | 88 | | |
| 9 | 15 | 53 | 3.5 | 7.3 | 90 | No | 90 | Ex. | |
| 10 | 200 | 700 | 3.5 | 15.7 | 94 | No | 91 | | |
| 11 | 280 | 980 | 3.5 | 12.4 | 94 | No | 91 | | |
| 12 | 200 | 360 | 1.8 | 17.8 | 75 | Yes | 69 | C.M. | |
| 13 | 120 | 330 | 2.8 | 10.0 | 75 | Yes | 70 | | |
| 14 | 200 | 700 | 3.5 | 1.5 | 94 | Yes | 85 | C.E. | |
| 15 | 200 | 700 | 3.5 | 22.1 | 94 | No | 70 | | |
| 16 | 200 | 450 | 2.3 | 10.0 | 85 | No | 88 | Ex. | Alloyed hot dip |
| 17 | 200 | 700 | 3.5 | 15.7 | 94 | No | 90 | | zinc-coated steel |
| 18 | 200 | 360 | 1.8 | 17.8 | 75 | Yes | 69 | C.M. | sheet |
| 19 | 120 | 330 | 2.8 | 10.0 | 90 | Yes | 71 | | |
| 20 | 200 | 450 | 2.3 | 10.0 | 85 | No | 88 | Ex. | Dual layer type |
| 21 | 200 | 700 | 3.5 | 15.7 | 94 | No | 90 | | alloyed hot dip |
| 22 | 200 | 360 | 1.8 | 17.8 | 75 | Yes | 68 | C.M. | zinc-coated steel |
| 23 | 120 | 330 | 2.8 | 10.0 | 90 | Yes | 70 | | sheet electroplated with Fe—Zn alloy |

Note:
*Level difference between recesses and protrusions
Ex. = Example, C.M. = Conventional method, C.E. = Comparative Example Example 3

Another example of the present invention will be explained in detail below by making reference to a steel sheet having uniformly distributed recesses and protrusions thereon as described below: the recesses having each a flat portion at the bottom and forming oil-pooling portions in an area of at least 30% of the surface, the size D of the protrusion top faces being from 10 to 450 μm, the level difference between the recesses and the protrusions being from 2 to 20 μm, the peak-to-peak distance of the protrusions being from 50 to 1000 μm, P/D satisfying the relationship $2.2<P/D<5$, and the recess area being at least 85% of the surface area.

Figure 10:
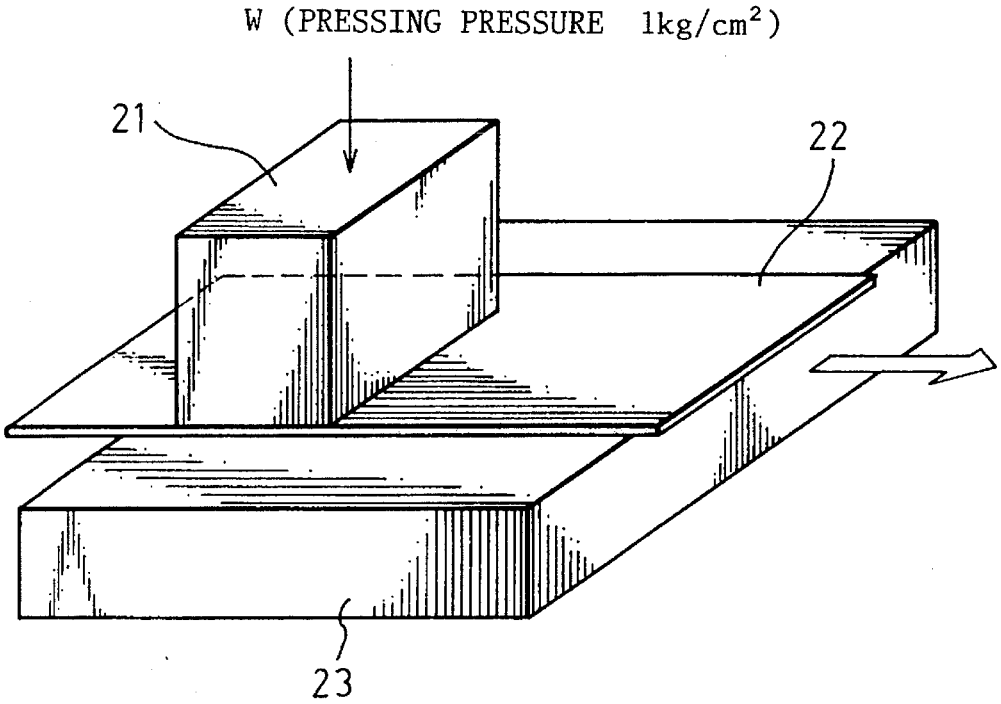
FIG. 10 is a drawing showing a test unit for evaluating the formation of defects on a steel sheet.

Fine patterns were formed on a skin pass roll by microlithography in a manner similar to that in Example 2. Cold rolled steel sheets and alloyed hot dip zinc-coated steel sheets (including those further electroplated with alloy) each having a thickness of 0.8 mm were skin pass rolled at a draft of 0.8% using the work roll. The plated steel sheets were prepared under the same conditions as those of the steel sheets in Example 2. The defect formation of the steel sheets thus obtained was evaluated by the test as shown in FIG. 10. The evaluation test is carried out as follows: a test steel sheet 22 is placed on a surface-finished surface plate 23 (Ra<0.05 μm) and is pressed downwardly by a surface-finished punch 21 (Ra<0.05 μm) at a pressing pressure of 1 kg/cm$^2$; the steel sheet free from coating oil is drawn at a rate of 100 mm/min; and the scratches, etc. thus formed thereon are visually observed after drawing. Moreover, the steel sheets subsequent to skin pass rolling were coated, and the coating sharpness was measured. The measurement was made in accordance with "a method for measuring specular gloss" specified by JIS Z 8741. Moreover, a measurement of an oil-pool area was made on the steel sheets by the following procedure. A steel sheet is coated with press working oil, and the oil is removed by a scraper, etc. A microphotograph of the steel sheet surface is taken after the removal of the press working oil, and the area to which the oil adheres (the oil remaining only in the oil-pool portions) is measured from the photograph. The results thus obtained are shown in Table 4. The press formability of the steel sheets in an oil-coated state in Table 4 was evaluated by a cylinder deep drawing test. The mark O designates no fracture formation and the mark X designates fracture formation in the deep drawing test in which a cylinder is formed, from a substrate steel sheet having a diameter of 80 mm at a draw ratio of 3.8.

It is evident from Table 4 that the steel sheets in Test Nos. 2 to 3, 7 to 11, 16 to 17 and 20 to 21 which belonged to examples of the invention exhibited significantly better results with regard to the defect formation and the coating sharpness compared with those in Test Nos. 1, 4 to 6, 14 and 15 of comparative examples, and those in Test Nos. 12, 13, 18 to 19 and 22 to 23 prepared by the conventional method disclosed in Japanese Unexamined Patent publication (Kokai) No. 63-132701.

It is clear from Table 4 that a steel sheet can be given excellent press formability as well as excellent defect-formation resistance and coating sharpness compared with steel sheets obtained by the conventional method by setting the oil-pool area, which is one of the requirements of the present invention, to as least 30% of the surface of the steel sheet.

TABLE 4

| Test No. | Mark size (steel sheet) Mark diameter D mm | Pitch P | P/D | Level difference between recesses and Protrusions | Area of recesses | Defect formation | Coating sharpness (%) | Oil-pool area (%) | Press form-ability | Note (1) | Note (2) |
|---|---|---|---|---|---|---|---|---|---|---|---|
| 1 | 8 | 53 | 6.6 | 1.5 | 98 | Yes | 80 | 23 | X | C.E. | |
| 2 | 11 | 53 | 4.8 | 7.5 | 95 | No | 92 | 32 | O | Ex. | |
| 3 | 200 | 980 | 4.9 | 5.3 | 95 | No | 92 | 38 | O | | |
| 4 | 440 | 1080 | 2.5 | 3.8 | 75 | Yes | 80 | 15 | X | | |
| 5 | 470 | 990 | 2.1 | 4.3 | 71 | Yes | 80 | 18 | X | C.E. | |
| 6 | 200 | 360 | 1.8 | 17.8 | 75 | No | 71 | 28 | X | | |
| 7 | 200 | 450 | 2.3 | 10.0 | 85 | No | 88 | 43 | O | Ex. | Cold-rolling steel sheet |
| 8 | 440 | 980 | 2.2 | 3.8 | 85 | No | 88 | 41 | O | | |
| 9 | 15 | 53 | 3.5 | 7.3 | 90 | No | 90 | 34 | O | | |
| 10 | 200 | 700 | 3.5 | 15.7 | 94 | No | 91 | 36 | O | | |
| 11 | 280 | 980 | 3.5 | 12.4 | 94 | No | 91 | 45 | O | | |
| 12 | 200 | 360 | 1.8 | 17.8 | 75 | Yes | 69 | 22 | X | C.M. | |
| 13 | 120 | 330 | 2.8 | 10.0 | 75 | Yes | 70 | 14 | X | | |
| 14 | 200 | 700 | 3.5 | 1.5 | 94 | Yes | 85 | 26 | X | C.E. | |
| 15 | 200 | 700 | 3.5 | 22.1 | 94 | No | 70 | 26 | X | | |
| 16 | 200 | 450 | 2.3 | 10.0 | 85 | No | 88 | 43 | O | Ex. | Alloyed hot dip zinc- |
| 17 | 200 | 700 | 3.5 | 15.7 | 94 | No | 90 | 37 | O | | coated steel sheet |
| 18 | 200 | 360 | 1.8 | 17.8 | 75 | Yes | 69 | 22 | X | C.M. | |
| 19 | 120 | 330 | 2.8 | 10.0 | 75 | Yes | 70 | 14 | X | | |
| 20 | 200 | 450 | 2.3 | 10.0 | 85 | No | 88 | 42 | O | Ex. | Dual layer type alloyed |
| 21 | 200 | 700 | 3.5 | 15.7 | 94 | No | 90 | 37 | O | | hot dip zinc-coated steel sheet |
| 22 | 200 | 360 | 1.8 | 17.8 | 75 | Yes | 68 | 21 | X | C.M. | electroplated with |
| 23 | 120 | 330 | 2.8 | 10.0 | 75 | Yes | 69 | 15 | X | | Fe—Zn alloy |

Note:
Ex. = Example, C.M. = Conventional method, C.E. = Comparative Example

POSSIBILITY OF UTILIZING THE INVENTION IN THE INDUSTRY

It is clear from the examples that a steel sheet can be made to have good press workability by imparting uniformly distributed recesses, as oil pools thereon, covering an area of at least 30% of the sheet. Moreover, a steel sheet excellent in coating sharpness and defect-formation resistance can be obtained by imparting regularly distributed protrusions thereon and restricting the protrusions in a certain range. Furthermore, it becomes possible to improve the coating sharpness, defect-formation resistance and workability of a steel sheet by providing uniformly distributing recesses and protrusions thereon and restricting their ranges. Accordingly, the present invention can realize a steel sheet having high formability and high quality (coating sharpness, defect-formation resistance) even when the steel sheet is highly strengthened, and, therefore, it is very useful in the industry.

We claim:

1. A steel sheet excellent in workability comprising recesses thereon which have each a flat portion at their bottom, form oil pools covering an area of at least 30% of the surface of the steel sheet and are uniformly distributed.

2. The steel sheet excellent in workability according to claim 1 wherein said steel sheet is a high tensile strength steel including a cold-rolled steel sheet or a steel sheet subjected to surface-treatment and having a tensile strength of at least 35 kgf/mm$^2$.

3. A steel sheet excellent in coating sharpness and defect-formation resistance comprising uniformly distributed protrusions thereon, the top faces of the regularly distributed protrusions having each a size D of 10 to 450 μm, the level difference between the recesses and the protrusions being from 2 to 20 μm, the peak-to-peak distance P of said protrusions being from 50 to 1000 μm, P and D satisfying the relationship 2.2<P/D<5, and the recesses area being at least 85%.

4. A steel sheet excellent in coating sharpness, defect-formation resistance and workability comprising uniformly distributed recesses and protrusions thereon, said recesses having each a flat portion at their bottom and forming oil pools covering an area of at least 30% of the surface of the steel sheet, the top faces of said protrusions each having a size D of 10 to 450 μm, the level difference between said recesses and said protrusions being from 2 to 20 μm, the peak-to-peak distance P of said protrusions being from 50 to 1000 μm, P and D satisfying the relationship 2.2<P/D<5, and the recess area being at least 85%.

5. The steel sheet excellent in coating sharpness, defect-formation resistance and workability according to claim 4 wherein said steel sheet is a high tensile strength steel including a cold-rolled steel sheet or a steel sheet subjected to surface-treatment and having a tensile strength of at least 35 kgf/mm$^2$.

6. A steel sheet excellent in workability comprising uniformly distributed recesses thereon each having a flat bottom, said recesses forming oil pools in an area of at least 30% based on the surface area of the steel sheet and each having a diameter of 20 to 600 μm, a pitch of 100 to 1000 μm, and a depth of 1 to 20 μm.

7. The steel sheet excellent in workability according to claim 1 wherein said steel sheet is a high tensile strength steel including a cold-rolled steel sheet or a steel sheet subjected to a surface-treatment and having a tensile strength of at least 35 kgf/mm$^2$.

8. A steel sheet excellent in coating sharpness and defect-formation resistance comprising uniformly distributed protrusions, the size D of the uniformly distributed protrusion top faces thereon each being from 10 to 450 μm, the level difference between recesses and the protrusions being from 2 to 20 μm, the peak-to-peak distance P of the protrusions being 50 to 1000 μm, P and D satisfying the relationship 2.2<P/D<5, and the recess area being at least 85%.

* * * * *